US012644652B2

(12) United States Patent
Wang

(10) Patent No.: US 12,644,652 B2
(45) **Date of Patent: *Jun. 2, 2026**

(54) WOVEN MESH STRUCTURE WITH CAPILLARY ACTION

(71) Applicant: ASIA VITAL COMPONENTS (CHINA) CO., LTD., Shenzhen (CN)

(72) Inventor: Rong-Yuan Wang, Shenzhen (CN)

(73) Assignee: ASIA VITAL COMPONENTS (CHINA) CO., LTD., Shenzhen (CN)

( * ) Notice: Subject to any disclaimer, the term of this patent is extended or adjusted under 35 U.S.C. 154(b) by 220 days.

This patent is subject to a terminal disclaimer.

(21) Appl. No.: 18/202,292

(22) Filed: May 26, 2023

(65) Prior Publication Data

US 2024/0392479 A1 Nov. 28, 2024

(51) Int. Cl.
*F28D 15/02* (2006.01)

(52) U.S. Cl.
CPC ..... *F28D 15/0233* (2013.01)

(58) Field of Classification Search
CPC ..... F28D 15/0233; F28D 15/046
See application file for complete search history.

(56) References Cited

U.S. PATENT DOCUMENTS

| | | | | |
|---|---|---|---|---|
| 2006/0213646 | A1* | 9/2006 | Hsu | F28D 15/046 165/104.26 |
| 2007/0295494 | A1 | 12/2007 | Mayer et al. | |
| 2010/0157533 | A1 | 6/2010 | Oniki et al. | |
| 2011/0088877 | A1* | 4/2011 | Oniki | H01L 23/427 29/890.032 |

FOREIGN PATENT DOCUMENTS

| | | | |
|---|---|---|---|
| CN | 2784857 | Y | 5/2006 |
| CN | 203672207 | U | 6/2014 |
| CN | 217936317 | U | 11/2022 |
| CN | 219802954 | U | 10/2023 |
| JP | S61-15088 | A | 1/1986 |
| TW | 201525402 | A | 7/2015 |
| TW | 202200951 | A | 1/2022 |

(Continued)

OTHER PUBLICATIONS

Search Report dated Jan. 11, 2024 issued by Taiwan Intellectual Property Office for counterpart application No. 112117006.

(Continued)

*Primary Examiner* — Jianying C Atkisson
*Assistant Examiner* — Khaled Ahmed Ali Al Samiri
(74) *Attorney, Agent, or Firm* — Demian K. Jackson; Jackson IPG PLLC

(57) ABSTRACT

A woven mesh structure with capillary action is applied to a two-phase fluid heat dissipation unit. The woven mesh structure includes multiple longitudinal lines and multiple latitudinal lines. At least two latitudinal lines with same thickness are selectively arranged as a latitudinal line set. The woven mesh structure is woven from the single longitudinal line and one latitudinal line set, which sequentially repeatedly intersect (and overlap with) each other. Accordingly, the number of the voids of the woven mesh structure is increased so that the woven mesh structure has better capillary attraction and water collection (containing) ability to greatly enhance the heat transfer performance.

6 Claims, 5 Drawing Sheets

(56) References Cited

FOREIGN PATENT DOCUMENTS

| | | |
|---|---|---|
| TW | M634207 U | 11/2022 |
| TW | M639337 U | 4/2023 |
| TW | M643616 U | 7/2023 |

OTHER PUBLICATIONS

Search Report dated Sep. 12, 2024 issued by Taiwan Intellectual Property Office for counterpart application No. 112117006.
Search Report dated Jun. 19, 2025 issued by China National Intellectual Property Administration for counterpart application No. 2023105155898.

* cited by examiner

WOVEN MESH STRUCTURE WITH CAPILLARY ACTION

BACKGROUND OF THE INVENTION

1. Field of the Invention

The present invention relates generally to a capillary structure, and more particularly to a woven mesh structure with capillary action. The woven mesh structure has better capillary attraction and water collection (containing) ability to enhance the capillary heat transfer performance.

2. Description of the Related Art

Along with the rapid advance of technologic and scientific industries, currently, many 3C electronic products are designed with lightweight, thin, short and small size. Under such circumstance, the heat dissipation unit disposed in the electronic product for dissipating or conducting the heat must be thinned in accordance with the thin electronic product. In this case, the heat dissipation unit employing transformation between two phases of a working fluid, such as a heat pipe or a vapor chamber, has been stressed. However, the heat conductivity of the two-phase fluid heat dissipation unit is mostly determined by the capillary structure.

Please refer to FIG. 4, which shows a flat and thin woven mesh capillary structure applied to an ultra-thin heat pipe. The flat and thin woven mesh capillary structure 5 includes multiple first weaving lines 51 extending in a longitudinal direction and multiple second weaving lines 52 extending a latitudinal direction. The first and second weaving lines 51, 52 repeatedly intersect each other and are woven with each other to form the flat and thin woven mesh capillary structure 5. Each two adjacent first weaving lines 51 and each two second weaving lines 52 together define a mesh. Each weaving line has multiple intersection sections 53 and multiple connection sections 54 serially connected between each two adjacent intersection sections 53. The intersection section 53 of each weaving line has a flat cross section, whereby the woven mesh capillary structure 5 is flattened and thinned.

However, the aforesaid conventional woven mesh capillary structure is simply composed of the first weaving lines 51 and the second weaving lines 52, which repeatedly intersect each other and are woven with each other. The first and second weaving lines 51, 52 have the same diameter (thickness). Therefore, after the first and second weaving lines 51, 52 longitudinally and latitudinally intersect (and overlap with) each other and are woven with each other, multiple voids with the same fixed size are formed in the woven mesh capillary structure. In addition, the number of the voids and the number of the meshes of the woven mesh capillary structure are fixed and limited. As a result, the application of the capillary attraction of the woven mesh capillary structure, (such as the enhancement of the water containing (collection) ability and the transverse water absorption ability of the entire woven mesh capillary structure or a local section of the woven mesh capillary structure), is too monotonous so that the woven mesh capillary structure cannot be flexibly utilized.

Therefore, the conventional woven mesh capillary structure can simply provide a limited number of voids and a limited number of meshes with the same size for absorbing the working fluid. In this case, the conventional woven mesh capillary structure cannot be freely designed in accordance with the type of the two-phase fluid heat dissipation unit to satisfy different heat dissipation requirements of the respective sections of the two-phase fluid heat dissipation unit. Therefore, the water containing ability of the woven mesh capillary structure is insufficient and the capillary attraction of the entire woven mesh capillary structure is poor. As a result, the two-phase fluid heat dissipation unit employing the woven mesh capillary structure cannot be flexibly utilized so that the backflowing is too slow and the water content of the evaporation face of the two-phase fluid heat dissipation unit is insufficient. Consequently, dry-out may take place on the evaporation face to lower the heat transfer performance.

It is therefore tried by the applicant to provide a woven mesh structure with capillary action, which has better capillary attraction and water containing ability to solve the problems of the conventional woven mesh capillary structure disposed in the heat dissipation unit.

SUMMARY OF THE INVENTION

It is therefore a primary object of the present invention to provide a woven mesh structure with capillary action. The woven mesh structure includes multiple longitudinal lines and multiple latitudinal lines. At least two latitudinal lines with same thickness are selectively arranged as a latitudinal line set. The woven mesh structure is woven from the single longitudinal lines and one latitudinal line set, which sequentially repeatedly intersect and overlap with each other. Accordingly, the number of the voids of the woven mesh structure is increased so that the woven mesh structure has better capillary attraction and water collection (containing) ability to enhance the heat transfer performance.

To achieve the above and other objects, the woven mesh structure with capillary action of the present invention is applied to and disposed in a two-phase fluid heat dissipation unit. The woven mesh structure includes multiple longitudinal lines and multiple latitudinal lines. At least two latitudinal lines with same thickness are selectively arranged as a latitudinal line set. The multiple longitudinal lines extend in a first weaving direction, while the multiple latitudinal line sets extend in a second weaving direction, whereby the single longitudinal line and one latitudinal line set sequentially repeatedly intersect (and overlap with) each other and are woven with each other to form the woven mesh structure.

The entire weaving area of the woven mesh structure or a local weaving area of the woven mesh structure of the present invention is woven from the single longitudinal line and one cooperative latitudinal line set, which sequentially repeatedly intersect and overlap with each other. Therefore, the number of the voids of the woven mesh structure is increased so that the woven mesh structure has better capillary attraction and water collection (containing) ability to enhance the capillary action. Moreover, the woven mesh structure can effectively directionally guide the working fluid and fully spread the working fluid (to quickly flow back).

Accordingly, the water collection (containing) ability of the evaporation face of the two-phase fluid heat dissipation unit is enhanced to avoid dry-out and promote the heat exchange efficiency.

Each of the longitudinal lines is repetitively woven over and under the latitudinal line sets, while the adjacent longitudinal lines that interlace with the same latitudinal line set have opposite weaving directions, causing the crests of all adjacent longitudinal lines to be arranged in an alternating up-and-down pattern.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
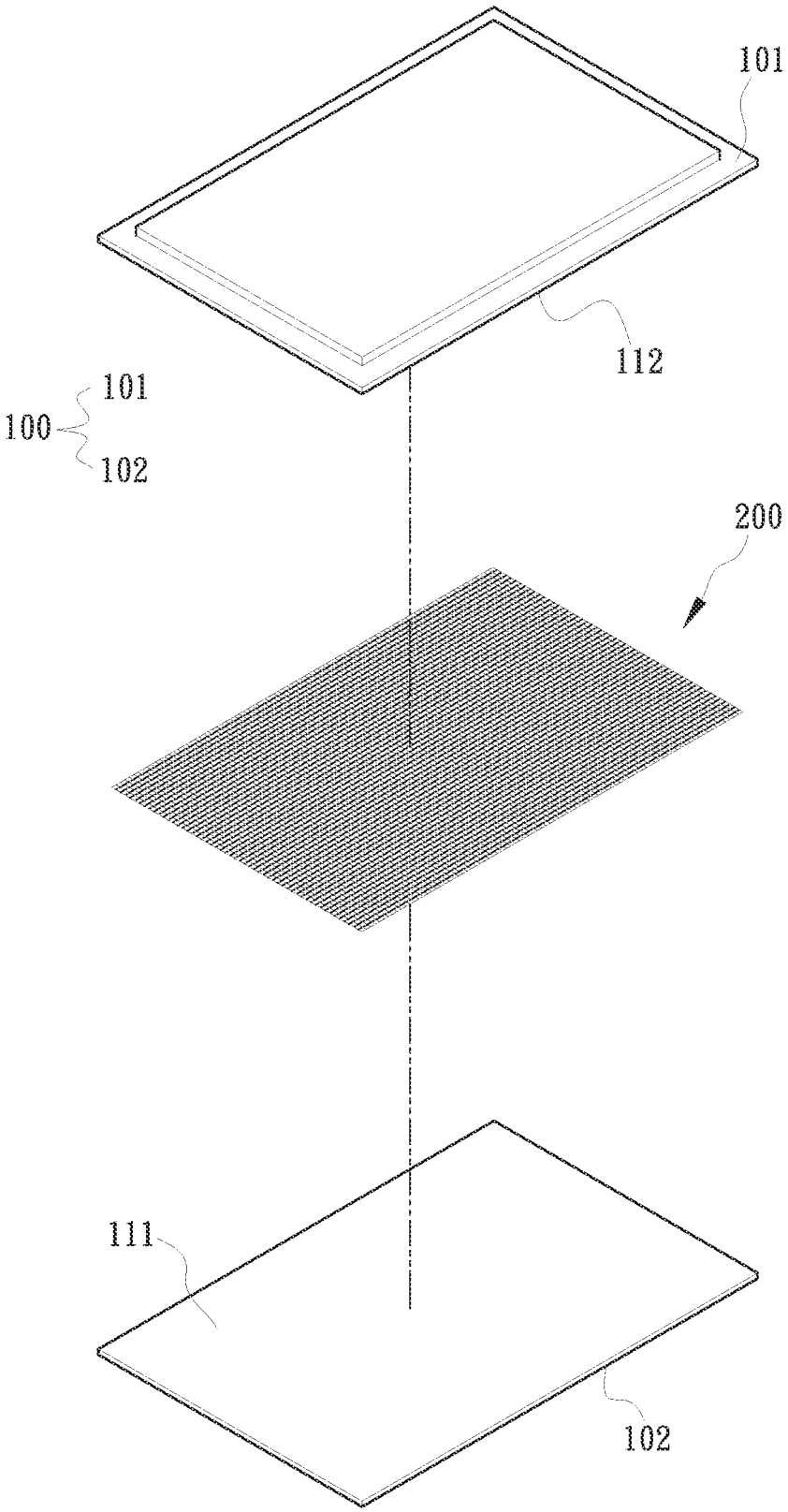
FIG. 1 is a perspective exploded view of the two-phase fluid heat dissipation unit of the present invention.
Figure 2A:
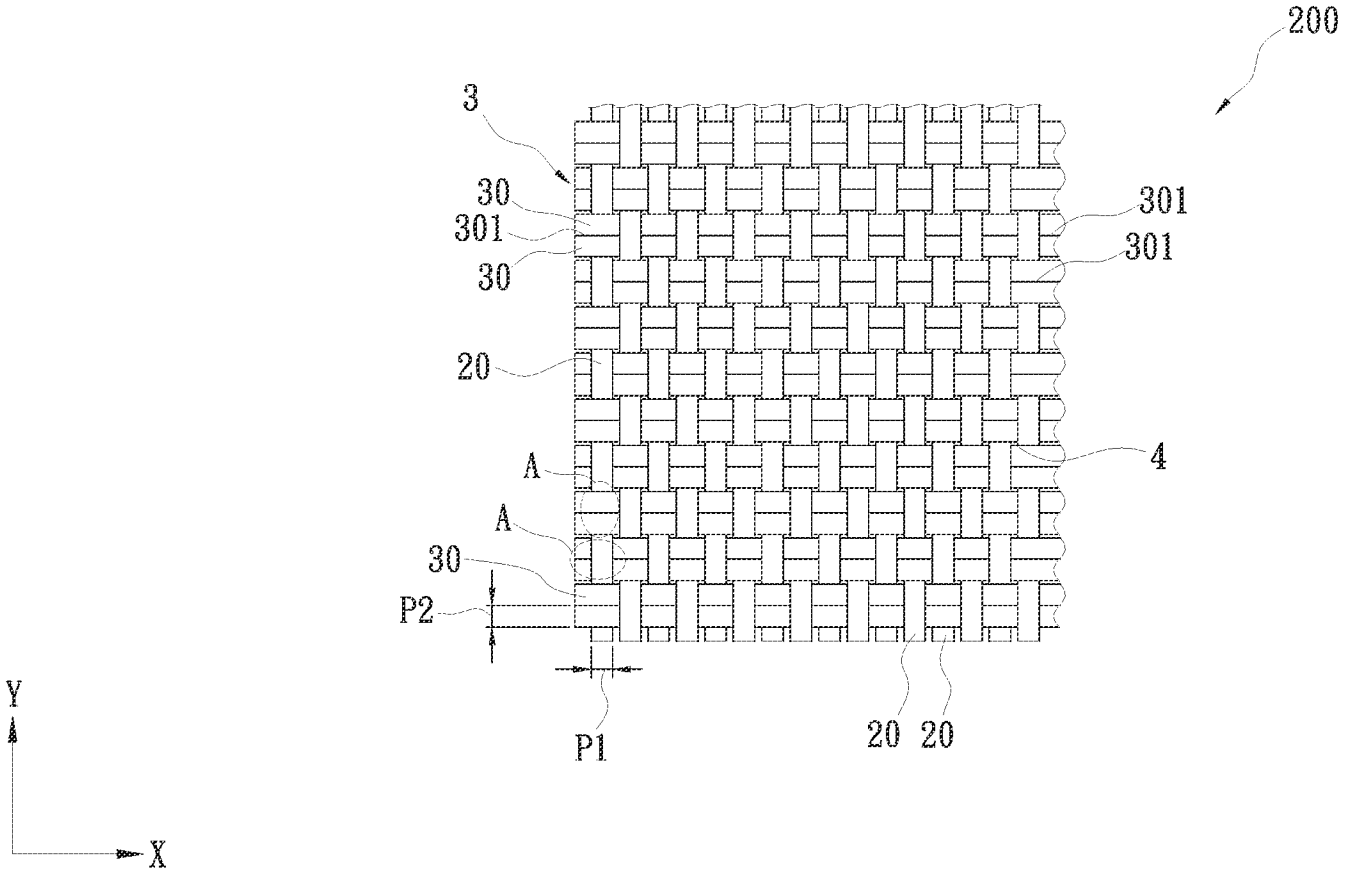
FIG. 2A is a top view of the woven mesh structure of the present invention.
Figure 2B:
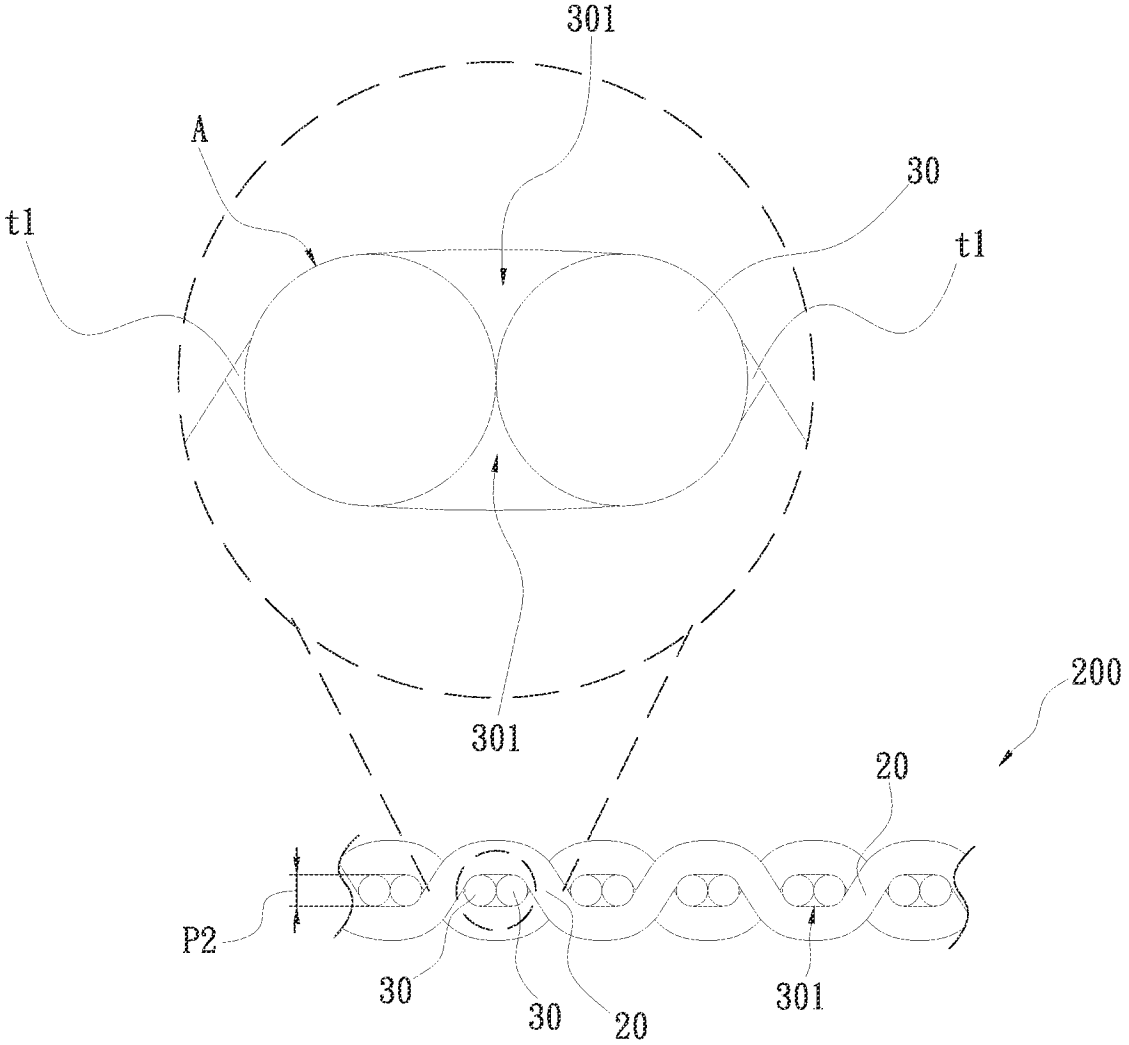
FIG. 2B is a left side view of the woven mesh structure of the present invention according to FIG. 2A.
Figure 3:
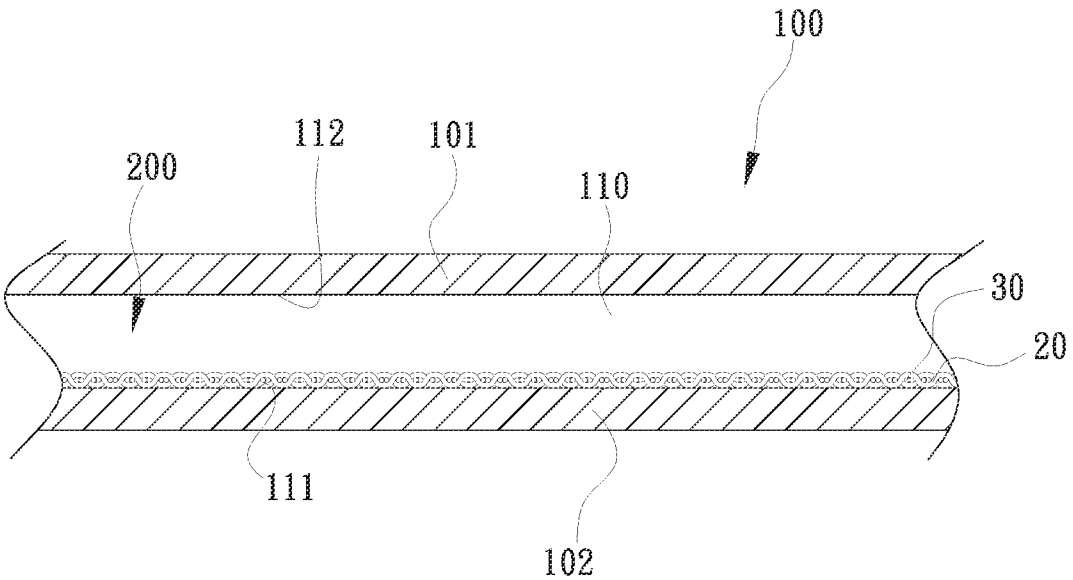
FIG. 3 is a sectional view showing that the woven mesh structure of the present invention is disposed in the two-phase fluid heat dissipation unit.
Figure 4:
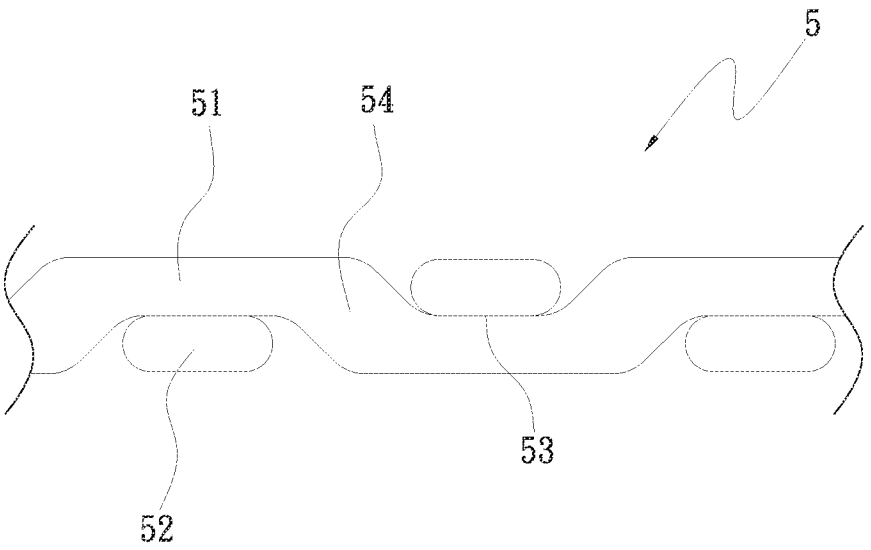
(PRIOR ART) Fig. 4
FIG. 4 is a side view of a conventional thinned flat-type woven mesh capillary structure.

Please refer to FIGS. 1, 2A, 2B and 3, which show the woven mesh structure with capillary action of the present invention. The woven mesh structure 200 is applied to a two-phase fluid heat dissipation unit 100 (such as a vapor chamber, a heat pipe, a loop-type heat pipe or any two-phase fluid device). The two-phase fluid heat dissipation unit 100 has a case body formed with a chamber. In the present invention, a vapor chamber is selected as an example of the two-phase fluid heat dissipation unit 100 for illustration purposes. The case body includes an upper plate 101 and a lower plate 102. The upper plate 101 is mated with the lower plate 102 to together define a chamber 110, in which a working fluid is filled (as shown in FIG. 3). The woven mesh structure 200 is at least selectively disposed on an inner surface of the upper plate 101 and/or the lower plate 102 of the chamber 110.

The woven mesh structure 200 includes multiple longitudinal lines 20 and multiple latitudinal lines 30. In this embodiment, as shown in FIGS. 2A and 2B, at least two latitudinal lines 30 are selectively arranged as a latitudinal line set 3 (the latitudinal line set 3 can alternatively selectively have more than two, such as three, four or more, latitudinal lines 30 in accordance with application requirement). The latitudinal lines 30 have the same diameter (thickness) and are tightly side-by-side arranged. The multiple latitudinal line sets 3 extend in a second weaving direction X (such as transverse direction), while the single longitudinal lines 20 extends in a first weaving direction Y (such as longitudinal direction) to sequentially repeatedly intersect (and overlap with) the multiple latitudinal line sets 3, whereby the multiple latitudinal line sets 3 and the multiple longitudinal lines 20 are woven into the woven mesh structure 200.

In addition, in the same weaving area, the sum of the diameters P2 of the latitudinal lines 30 of each latitudinal line set 3 is smaller than or equal to the diameter P1 of one single longitudinal line 20. Therefore, the number of the latitudinal lines 30 is increased to define more voids t1 in the woven mesh structure 200. Please refer to FIGS. 2A and 2B. To speak more specifically, each longitudinal line 20 sequentially repeatedly intersects (and overlaps with) the two latitudinal lines 30 of each latitudinal line set 3 to form multiple intersection sections A. The voids t1 in each intersection section A are defined between the longitudinal line 20 and outer circumferences of the two latitudinal lines 30. Accordingly, the number of the voids t1 is increased.

Therefore, the entire weaving area or a local weaving area of the woven mesh structure 200 of the present invention is woven from the single longitudinal line 20 and one cooperative latitudinal line sets 3. Accordingly, the woven mesh structure 200 has more voids t1 and thus better water collection (containing) property so as to achieve better capillary action. Therefore, the capillary attraction of the woven mesh structure 200 is enhanced to provide higher heat dissipation efficiency. In practice, in accordance with the type of the two-phase fluid heat dissipation unit 100 (such as vapor chamber or heat pipe) and/or the position where a heat source is positioned, which requires higher water collection (containing) ability and better capillary action, all of or a part (a local section) of the woven mesh structure 200 can be such designed that the single longitudinal line 20 and one latitudinal line set 3 (having multiple latitudinal lines 30 with the same thickness) are cooperatively woven with each other. In addition, the intervals between the longitudinal line 20 and the longitudinal line 20 and/or the latitudinal line 30 and the latitudinal line 30 are adjustable so as to adjust the density of the longitudinal lines 20 and the latitudinal lines 30. Accordingly, the number of the longitudinal lines 20 and the number of the cooperative latitudinal lines 30 can be flexibly varied for different applications. Therefore, the flow guiding (backflowing) and water collection (containing) ability and the capillary action of all of or a local section of the woven mesh structure 200 can be adjusted, whereby the woven mesh structure 200 can be more effectively applied to various two-phase fluid heat dissipation units 100 to satisfy the heat dissipation requirements of the respective sections of the two-phase fluid heat dissipation units 100.

The longitudinal line 20 of the present invention can have a circular cross section (as shown in FIG. 2B) or a noncircular cross section (such as an elliptic cross section, a flat cross section, a beehive-shaped cross section or any other geometrical cross section).

The configurations of the cross sections of the multiple latitudinal lines 30 of the latitudinal line set 3 can be identical to each other or different from each other (as shown in FIG. 2B, which is a left side view according to FIG. 2A). In FIG. 2B, the two latitudinal lines 30 of the latitudinal line set 3 have circular cross sections identical to each other. Alternatively, the two latitudinal lines 30 of the latitudinal line set 3 can have noncircular cross sections or any other geometrical cross sections. Moreover, at least two flow-guiding micro-passages 301 are formed between the two latitudinal lines 30 of each latitudinal line set 3. The two flow-guiding micro-passages 301 are respectively positioned above and under contact sections of the two latitudinal lines 30 and extend in a lengthwise direction of the latitudinal lines 30.

Furthermore, the longitudinal lines 20 and the latitudinal lines 30 can be made of metal or nonmetal materials (plastic or stone materials). That is, the longitudinal lines 20 and the latitudinal lines 30 can be made of the same material (or different materials collocated with each other).

Further referring to FIGS. 1, 2A and 3, an outer side of the lower plate 102 of the two-phase fluid heat dissipation unit 100 is attached to (in contact with) a heat source (such as a central processing unit or a graphics processing unit or any other electronic unit, not shown). An inner side of the lower plate 102 serves as an evaporation face 111, while an inner side of the upper plate 101 serves as a condensation face 112 opposite to the evaporation face 111. The woven mesh structure 200 of the present invention can be disposed on the evaporation face 111 of the inner side of the lower plate 102. When the lower plate 102 of the two-phase fluid heat dissipation unit 100 absorbs the heat of the heat source, the heat is transferred to the evaporation face 111, whereby the liquid working fluid on the evaporation face 111 is evaporated into vapor working fluid, which flows to the condensation face 112. After the condensation face 112 heat-exchanges with the external air, the vapor working fluid is again condensed into the liquid working fluid. Then, under gravity or the capillary attraction of other capillary structures, the liquid working fluid goes from the condensation face 112 back to the inner side of the lower plate 102.

In the woven mesh structure 200 of the present invention, the number of the longitudinal lines 20 is different from and in a certain proportion to the number of the latitudinal lines 30 of the cooperative latitudinal line sets 3. Therefore, the woven mesh structure 200 has more voids t1 and more flow-guiding micro-passages 301 for speeding the back-flowing of the working fluid from the condensation face 112 to the evaporation face 111. In addition, the voids t1 and the flow-guiding micro-passages 301 of the woven mesh structure 200 serve to directionally guide the working fluid to quickly spread over the evaporation face 111, whereby the evaporation face 111 of the woven mesh structure 200 has better water collection (containing) ability to avoid dry-out. Accordingly, the rate of boiling and evaporation of the working fluid on the evaporation face 111 in response to the temperature is enhanced. Moreover, not only the condensed working fluid quickly continuously flows from the condensation face 112 back to the evaporation face 111 to avoid dry-out, but also the circular transformation between the liquid phase and the vapor phase of the working fluid in the chamber 110 is effectively speeded to enhance the heat dissipation performance.

Accordingly, the entire weaving section (area) of the woven mesh structure 200 of the present invention is, but not limited to, formed of the single longitudinal line 20 and one latitudinal line sets 3 (having multiple latitudinal lines 30 with the same thickness) collocated and woven with each other. Alternatively, in a modified embodiment, only a local weaving section (area) of the woven mesh structure 200 is formed of the single longitudinal line 20 and one latitudinal line set 3 (having multiple latitudinal lines 30 with the same thickness) collocated and woven with each other, while the remaining section of the woven mesh structure 200 is conventionally formed of the single longitudinal line 20 and the single latitudinal line 30 collocated and woven with each other. For example, the woven mesh structure 200 has a heat source contact section corresponding to a heat source and a peripheral section around the heat source contact section. The heat source contact section is positioned at a center of the woven mesh structure 200 and is conventionally woven from the single longitudinal line 20 and the single latitudinal line 30, which sequentially repeatedly intersect (and overlap with) each other, while the peripheral section is woven from the single longitudinal lines 20 and one cooperative latitudinal line set 3, which sequentially repeatedly intersect (and overlap with) each other. To speak more specifically, the heat source contact section of the woven mesh structure 200 is disposed in the chamber 110 of the two-phase fluid heat dissipation unit 100 corresponding to the evaporation face 111 in contact with the heat source. After the liquid working fluid contained in the heat source contact section of the woven mesh structure 200 is heated, the liquid working fluid is quickly evaporated into the vapor working fluid. The peripheral section of the woven mesh structure 200 has greater capillary attraction and better water collection (containing) ability so that the condensed working fluid can more quickly flow back to the peripheral section around the heat source contact section. Accordingly, the liquid working fluid can be collected and contained in the peripheral section and supplied to the heat source contact section at a proper time to avoid dry-out of the evaporation face 111.

Alternatively, as necessary, any of the heat source contact section and the peripheral section of the woven mesh structure 200 of the present invention can be formed of the single longitudinal line 20 and one latitudinal line set 3 collocated and woven with each other.

In conclusion, the woven mesh structure 200 of the present invention is woven from the single longitudinal lines 20 and one cooperative latitudinal line set 3 having at least two latitudinal lines 30, which sequentially repeatedly intersect (and overlap with) each other. In a fixed weaving area of the woven mesh structure, the number of the voids is greatly increased. Moreover, the number of the longitudinal lines 20 and the number of the cooperative latitudinal lines 3 are flexibly variable, whereby the woven mesh structure 200 can have more flow-guiding micro-passages 301. Accordingly, the woven mesh structure 200 can directionally guide the working fluid to quickly spread and flow. Moreover, the woven mesh structure 200 has excellent water collection (containing) ability and better capillary action to enhance the heat exchange efficiency.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A woven mesh structure with capillary action comprising:

a longitudinal line extending in a first weaving direction and a latitudinal line set having at least two latitudinal lines of uniform size extending in a second weaving direction, the longitudinal line and the latitudinal line set sequentially and repeatedly intersecting and overlapping with each other to form the woven mesh structure, wherein, within a same weaving area, a sum of diameters of the at least two latitudinal lines of the latitudinal line set is less than or equal to a diameter of the longitudinal line, whereby a number of the latitudinal lines and a number of voids of the woven mesh structure within the same weaving area is increased to enhance capillary attraction and water collection ability.

2. The woven mesh structure with capillary action as claimed in claim 1, wherein at least one latitudinal line of the latitudinal line set has a circular cross section.

3. The woven mesh structure with capillary action as claimed in claim 1, wherein the longitudinal line has a circular cross section.

4. The woven mesh structure with capillary action as claimed in claim 1, wherein the longitudinal line and the at least two latitudinal lines are made of metal material.

5. The woven mesh structure with capillary action as claimed in claim 1, wherein the woven mesh structure is disposed in a two-phase fluid heat dissipation unit, the two-phase fluid heat dissipation unit including an upper plate and a lower plate mated with the upper plate to together define a chamber, in which a working fluid is filled, the woven mesh structure being disposed on an inner side of the lower plate in the chamber.

6. The woven mesh structure with capillary action as claimed in claim 1, wherein an entire weaving area of the woven mesh structure is woven from the longitudinal line and the latitudinal line set, which sequentially and repeatedly intersect and overlap with each other.

* * * * *